US012611036B2

(12) United States Patent
Jamesapollos

(10) Patent No.: US 12,611,036 B2
(45) Date of Patent: Apr. 28, 2026

(54) STACKABLE LIFT FOR ISCHIAL TUBEROSITY RE-ALIGNMENT OF SACRAL/LUMBAR COMPLEX AND METHOD OF USE

(71) Applicant: The Well Effect Company, Bedford, MA (US)

(72) Inventor: John Jamesapollos, Bedford, MA (US)

(73) Assignee: The Well Effect Company, Bedford, MA (US)

( * ) Notice: Subject to any disclaimer, the term of this patent is extended or adjusted under 35 U.S.C. 154(b) by 297 days.

(21) Appl. No.: 17/961,420

(22) Filed: Oct. 6, 2022

(65) Prior Publication Data

US 2023/0107718 A1 Apr. 6, 2023

Related U.S. Application Data

(60) Provisional application No. 63/262,186, filed on Oct. 6, 2021.

(51) Int. Cl.
*A47C 7/02* (2006.01)

(52) U.S. Cl.
CPC ..... *A47C 7/02* (2013.01)

(58) Field of Classification Search
CPC ..... A47C 7/021; A47C 7/024; A47C 7/0213; A61G 7/1043; A61G 7/1045
See application file for complete search history.

(56) References Cited

U.S. PATENT DOCUMENTS 395,043 A * 12/1888 Doremus ..... A47G 9/10 5/640
2,799,323 A 7/1957 Berg
3,749,442 A 7/1973 Berg et al.
3,934,933 A * 1/1976 Long ..... A47C 7/029 297/219.1
4,824,171 A * 4/1989 Hollingsworth ..... A47C 1/146 297/351

(Continued)

FOREIGN PATENT DOCUMENTS

RU 2481054 5/2013
WO 2003034870 5/2003
WO WO-2019168414 A1 * 9/2019 ..... A47C 7/021

OTHER PUBLICATIONS

Earthlite, Sacral Blocks, Jul. 19, 2016.

*Primary Examiner* — Eric J Kurilla
(74) *Attorney, Agent, or Firm* — Epstein Drangel LLP

(57) ABSTRACT

An adjustable support for differentially adjusting the height of a user's ischial tuberosity to relieve pain from sitting is disclosed. The support includes an adjustable left and right platform, each including at least one stackable lift having a stiffness sufficient to provide pressure to lift the sitz bone(s). Each lift is shaped and sized so that it can be securely stacked on top of the other. The stackable lifts may be connected along an inner edge in a hinged manner or can be received within at least one pouch and movable between the left and right platforms. To lift the height of the lower sitz bone the right and left platforms have a differential height between them, determined by the amount of adjustment needed. The differential adjustable seating height creates a counterbalancing repositioning of the sitz bones relieving the asymmetrical pressure of the sacral/lumbar complex caused by misalignment.

7 Claims, 10 Drawing Sheets

(56) References Cited

U.S. PATENT DOCUMENTS

| | | | | |
|---|---|---|---|---|
| 5,884,977 | A | 3/1999 | Swamy et al. | |
| 6,595,586 | B2 | 7/2003 | Brightbill et al. | |
| 6,786,542 | B1 | 9/2004 | Nuzzarello | |
| 6,829,799 | B2 | 12/2004 | Kuhn | |
| 6,866,340 | B1 | 3/2005 | Robertshaw | |
| D702,460 | S * | 4/2014 | Unger | D6/601 |
| 9,427,086 | B2 | 8/2016 | Willingham | |
| 9,661,928 | B2 | 5/2017 | Patrick et al. | |
| 2001/0040402 | A1* | 11/2001 | Odderson | A61G 5/1045 297/452.21 |
| 2006/0253989 | A1* | 11/2006 | Robinson | A47C 7/021 5/656 |
| 2007/0102968 | A1* | 5/2007 | Pearse | A47C 7/024 297/158.1 |
| 2008/0028529 | A1* | 2/2008 | Abell | A47G 9/0253 5/636 |
| 2009/0222992 | A1* | 9/2009 | Loewenthal | A61G 5/1043 5/653 |
| 2017/0000264 | A1 | 1/2017 | Krishtul | |
| 2019/0380460 | A1* | 12/2019 | Marsh | A45F 4/02 |
| 2022/0225775 | A1* | 7/2022 | Salter | A47C 7/021 |

* cited by examiner

STACKABLE LIFT FOR ISCHIAL TUBEROSITY RE-ALIGNMENT OF SACRAL/LUMBAR COMPLEX AND METHOD OF USE

CROSS-REFERENCE TO RELATED APPLICATIONS

This application claims the benefit of priority to U.S. Provisional Patent Application No. 63/262,186, filed Oct. 6, 2021 and entitled "Stackable Lift for Ischial Tuberosity Re-Alignment of Sacral/Lumbar Complex and Method of Use," the contents of the application being incorporated herein by reference in its entirety.

TECHNICAL FIELD

The present disclosure relates to a device to reduce physical stress on the user when sitting by re-balancing the body through re-alignment of the sacral/lumbar complex by adjusting the ischial tuberosity or "sitz" bones. More particularly, but not exclusively, to an adjustable leveling support that corrects dysfunctional alignment and helps stabilize and reduce back pain by selectively and differentially changing the height of a user's ischial tuberosity through stackable or expandable layers or lifts. The device may be incorporated into clothing or utilized in conjunction with a sitting surface.

BACKGROUND

The ischial tuberosity ("sitz bones") is a widening of the bone on either side of the frontal portion of the ischium, the lowest of the three major bones that make up each half of the pelvis. When sitting, the sit(z) bones are the bones that an individual sits on and that their weight is carried by. If a person suffers from back and hip pain from misalignment of the sacral/lumbar complex, then sitting is a known activity that will make the problem worse. This misalignment causes uneven pressure to be placed on the sacrum, the triangular bone at the base of the spine directly above the tailbone (i.e., coccyx) often resulting in discomfort or pain particularly while sitting for longer periods of time. Prolonged or repetitive sitting is known to cause damaging effects on an individual's body. Prolonged static seating has been linked to back problems because of the prolonged static pressure on the spine. The prolonged static pressure on the spine can impair balanced pressure on the lumbar discs, impairing glucose transport, disc nutrition, irritation and the elimination of waste products as well as migration of the disc towards pain sensitive structures. Unfortunately, sitting can often not be avoided, and studies show that the average American adult now spends about 6½ hours a day sitting. Numerous methods and treatments have been devised to ease the pain while sitting. A majority of methods utilize cushioning in order to try to cushion the pelvis and related bones to ease the pain while sitting. For example, a sitting bone cushion including a right aperture and a left aperture for relieving pressure on the ischial tuberosities of a person seated in the cushion is disclosed in U.S. Pat. No. 9,723,928.

Similarly, U.S. Pat. No. 6,829,799 is directed to a seat cushion including a first 20 and second 22 pillar positioned specifically for receiving the ischial tuberosities of a user. Graduated slots 24 are provided to create the cushion pillars. The slots 24 provide a transition from the greater pressure relief of the pillar to the lesser pressure relief of the intact cushioning member. Pillars 20, 22 along with graduated slot(s) 24 weaken cushioning member 12 resistance to compression under a user's ischial tuberosities, thus compressing more in the area of the user's ischial tuberosities.

In addition, U.S. Pat. No. 9,661,928 discloses a seat assembly 16 that utilizes cushioning air bladders 26, 28 whose volumes are equally adjusted by the use of a compressor 22. Air bladders 26, 28 each include a primary region received in a seat bottom of a seat assembly. The primary region is expandable in a height direction to support a pelvis of an occupant. At least one of the air bladder assemblies is adjusted to balance an uneven occupant seating position for improved comfort.

These devices mistakenly try to ease the pain caused by sitting by providing equal sided cushioning, which can exacerbate the pain and problem, by providing a structure that is soft and compresses as the user sits upon it.

SUMMARY

Contrary to prior art devices that attempt to relieve discomfort through cushioning, the present device and method disclosed herein instead utilizes a more rigid or stiff supportive structure in order to correct misalignment by adjusting the seating position of the user by affecting the relative height of the user's sitz bones at the point of contact with the seat and create a re-alignment of the sacral/lumbar complex that dramatically reduces pain.

This is achieved through an adjustable support that adjusts and corrects for inherent or acquired misalignment of the sacral/lumbar complex at the ischial tuberosity when sitting by adjusting the seating height differentially (left side versus right side) at the individual's ischial tuberosity in order to elevate one side to re-align it. This differentially adjustable seating height at the point of contact of the person's sitz bones and the seat creates a corrective repositioning of the sacral/lumbar complex thereby relieving the pressure on the sacral/lumbar complex caused by the misalignment i.e., any painful hip or back functional asymmetry of the persons sacrum and spine.

In a first exemplary embodiment, the adjustable support for differentially adjusting the height of the user's sitz bone is designed for use on a seat surface, for example a chair. In this embodiment the adjustable support includes an adjustable left platform and an adjustable right platform that each include at least one stackable or expandable lift that is relatively thin and has a stiffness sufficient to hold its form and provide pressure to lift the sitz bone(s) of the user creating a difference in the height of the left side versus the right. The lifts each include a complimentary shape so that each lift can be stacked on top of the other. Each of the lifts may have the same shape, or different shapes, as long as they support stacking. The lifts may be connected along an inner edge in a hinged or flipped manner, so that the plurality of lifts can be moved to adjust the height of either of the right or left platform. Once adjusted in order to lift the height of one of the sitz bones, the right and left platforms will have a differential height between them, determined by the amount of adjustment needed to relieve pain as determined by the user or a clinician.

Alternatively, the support may be non-adjustable such that it is constructed with standardized differences between the right and left side of the ischial tuberosity platforms rather than having adjustable, stackable layers or lifts. In this exemplary embodiment, the support would function the same, but would have a single platform on each side with a fixed or set height differential between them, determined by the amount of adjustment needed to relieve pain.

In another exemplary embodiment, the adjustable support is worn in a garment of the user. In this embodiment the adjustable support also includes adjustable left and right platforms that include at least one stiff, i.e., relative rigid, stackable lift that is also thin. However, the lifts are separate pieces that are received within a pocket formed in the seat of a piece of clothing and positioned where the user's ischial tuberosity is located in order to lift the left or right-side during seating to correct for misalignment by adjusting each side appropriately.

In either embodiment, if the user has right sided discomfort or pain the device will be used with the corrective effect of the device higher on the right side of the user by utilizing more of the adjustable lifts on the right in order to raise the user's ischial tuberosity on the right to correct for misalignment. The same is true for left-sided discomfort or pain when sitting. For the fixed support, relieving pain or discomfort is achieved by choosing a support having platforms with the correct height differential to raise the user's ischial tuberosity on the right or left, as may be the case, to correct for misalignment.

As will be appreciated, the adjustable support is reversible and can be used interchangeably for either right side or left side discomfort or pain by simply changing the orientation. In either adjustable embodiment the relative height difference of the one side and the other side can be adjusted from approximately ⅛" to 1".

BRIEF DESCRIPTION OF THE DRAWINGS

Various aspects of at least one embodiment are discussed below with reference to the accompanying figures, which are not necessarily drawn to scale, emphasis instead being placed upon illustrating the principles disclosed herein. The figures are included to provide an illustration and a further understanding of the various aspects and embodiments and are incorporated in and constitute a part of this specification but are not intended as a definition of the limits of any particular embodiment. The figures, together with the remainder of the specification, serve only to explain principles and operations of the described and claimed aspects and embodiments, but are not to be construed as limiting embodiments. In the figures, each identical or nearly identical component that is illustrated in various figures is represented by a like numeral. For purposes of clarity, not every component may be labeled in every figure.

DETAILED DESCRIPTION OF THE ILLUSTRATIVE EMBODIMENTS

The examples of the apparatus and method discussed herein are not limited in application to the details of construction and the arrangement of components set forth in the following description or illustrated in the accompanying drawings. It will be understood to one of skill in the art that the apparatus is capable of implementation in other embodiments and of being practiced or carried out in various ways. Examples of specific embodiments are provided herein for illustrative purposes only and are not intended to be limiting. Also, the phraseology and terminology used herein is for the purpose of description and should not be regarded as limiting. Any references to examples, embodiments, components, elements or acts of the apparatus and method herein referred to in the singular may also embrace embodiments including a plurality, and any references in plural to any embodiment, component, element or act herein may also embrace embodiments including only a singularity (or unitary structure). For example, the platforms that are shown as separate structures may be made as a single, unitary structure with a binding therebetween. References in the singular or plural form are not intended to limit the presently disclosed apparatus, its components, acts, or elements. As used herein, the singular forms "a", "an" and "the" are intended to include the plural forms as well, unless the context clearly indicates otherwise. The use herein of "including," "comprising," "having," "containing," "involving," and variations thereof is meant to encompass the items listed thereafter and equivalents thereof as well as additional items. References to "or" may be construed as inclusive so that any terms described using "or" may indicate any of a single, more than one, and all of the described terms. As also used herein the term ischial tuberosity and sitz bone(s) are used interchangeably.

Figure 1:
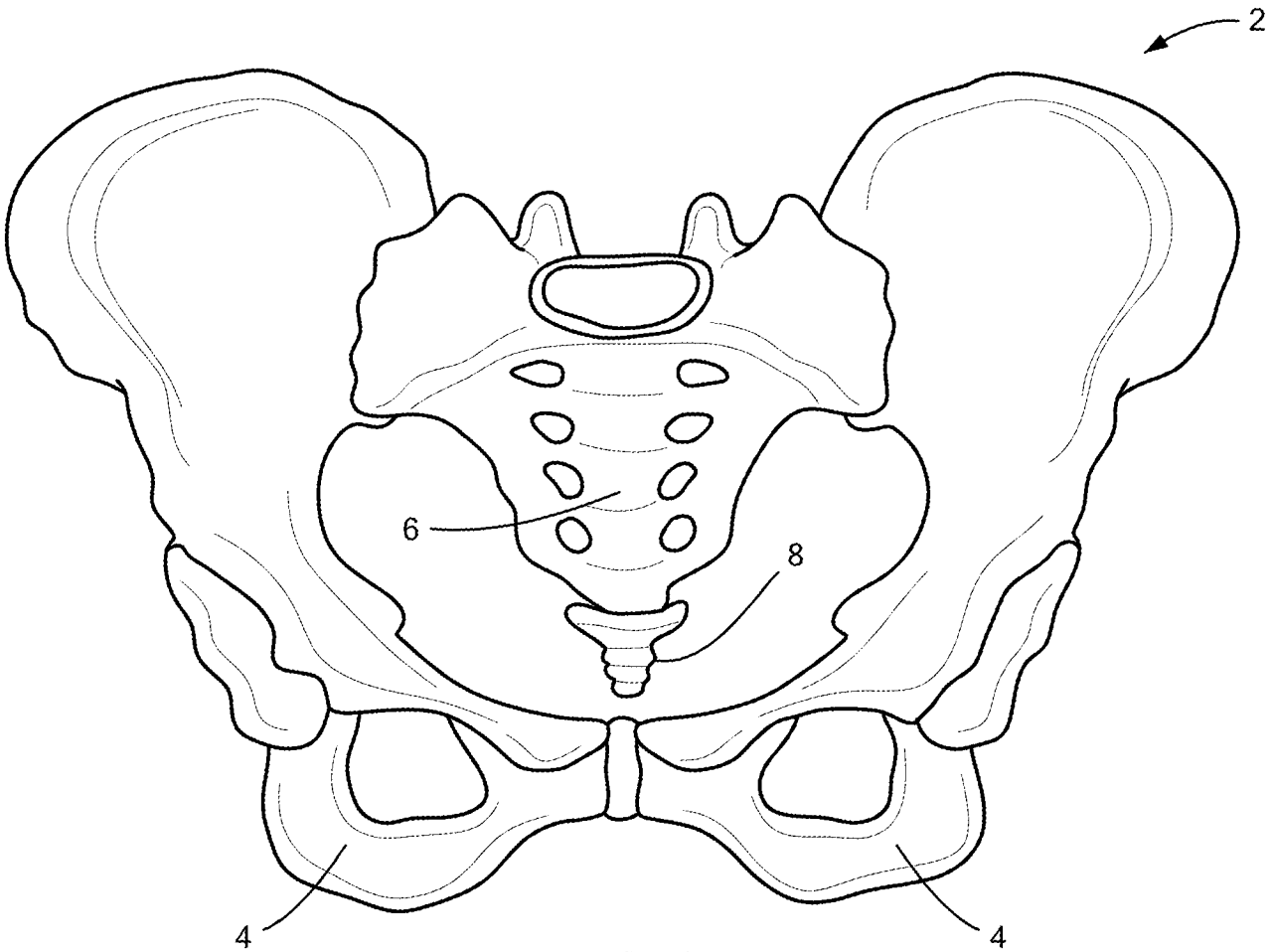
FIG. 1 PRIOR ART
FIG. 1 is a prior art perspective view of the bones making up the pelvic girdle.

FIG. 1 illustrates the bones making up the pelvic girdle 2 including the position of the ischial tuberosity 4, sacrum 6, and coccyx (tailbone) 8. This figure is used for reference purposes as to the location of the various bones discussed herein.

Figure 2:
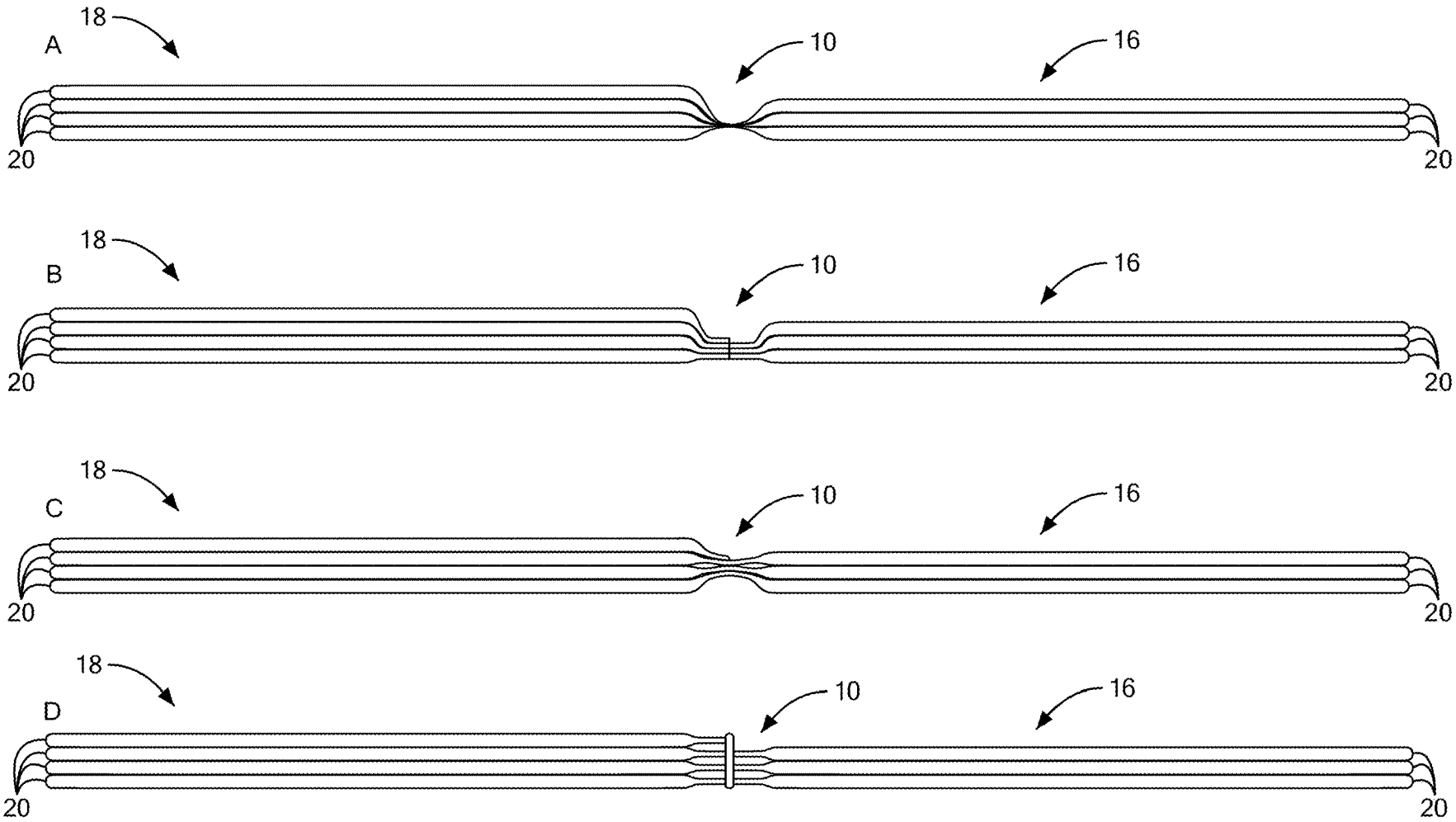
FIG. 2 is a front plan view of an adjustable support for differentially adjusting the height of the user's sitz bone on the painful side during sitting illustrating various height combinations designed for use on a seat surface in accordance with a first embodiment of the present disclosure.
Figure 3A:
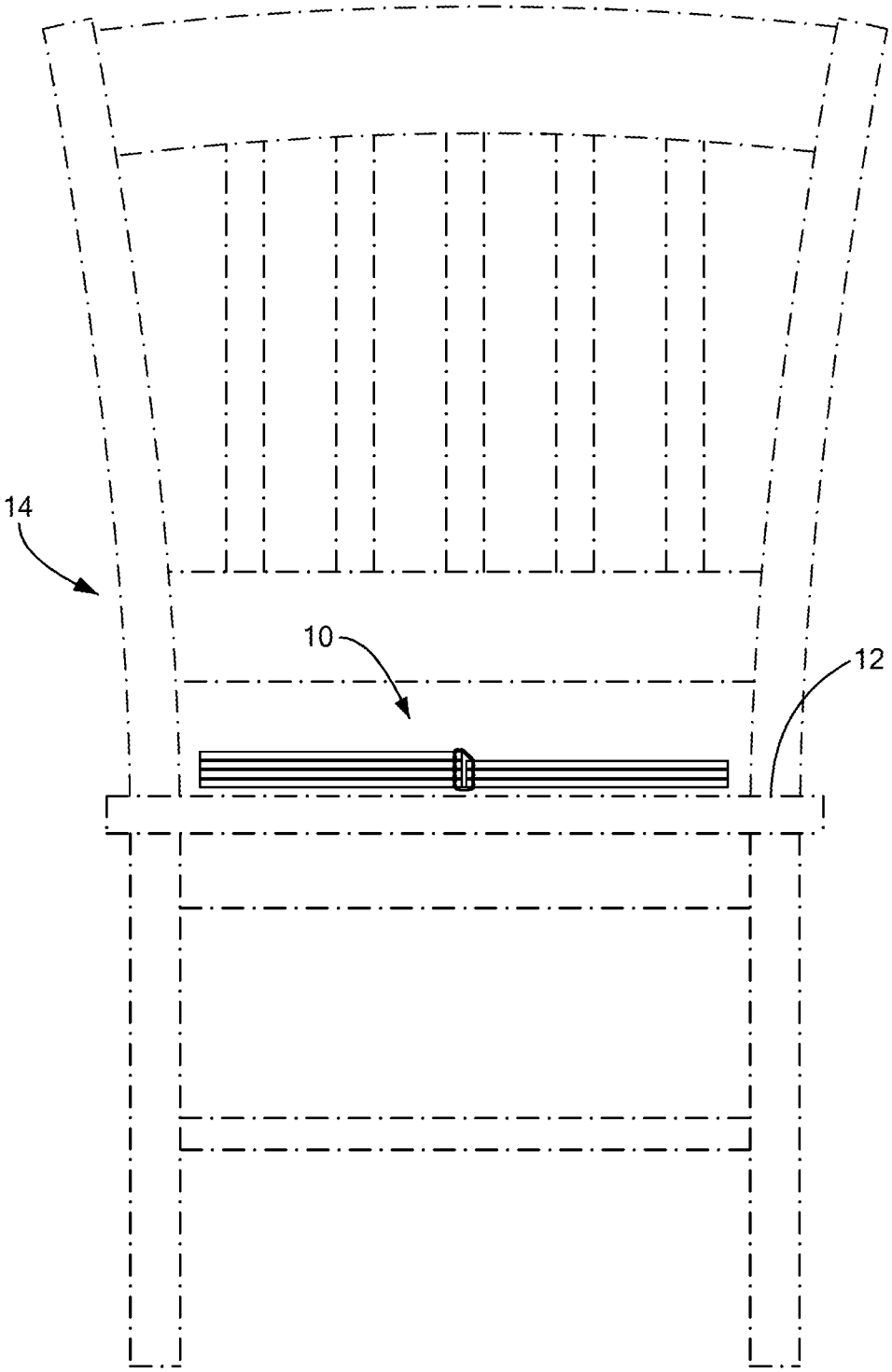
FIG. 3A is a front plan view of the support of FIG. 2 as used on a chair illustrating adjustable lifts on both the left and right platform.
Figure 3B:
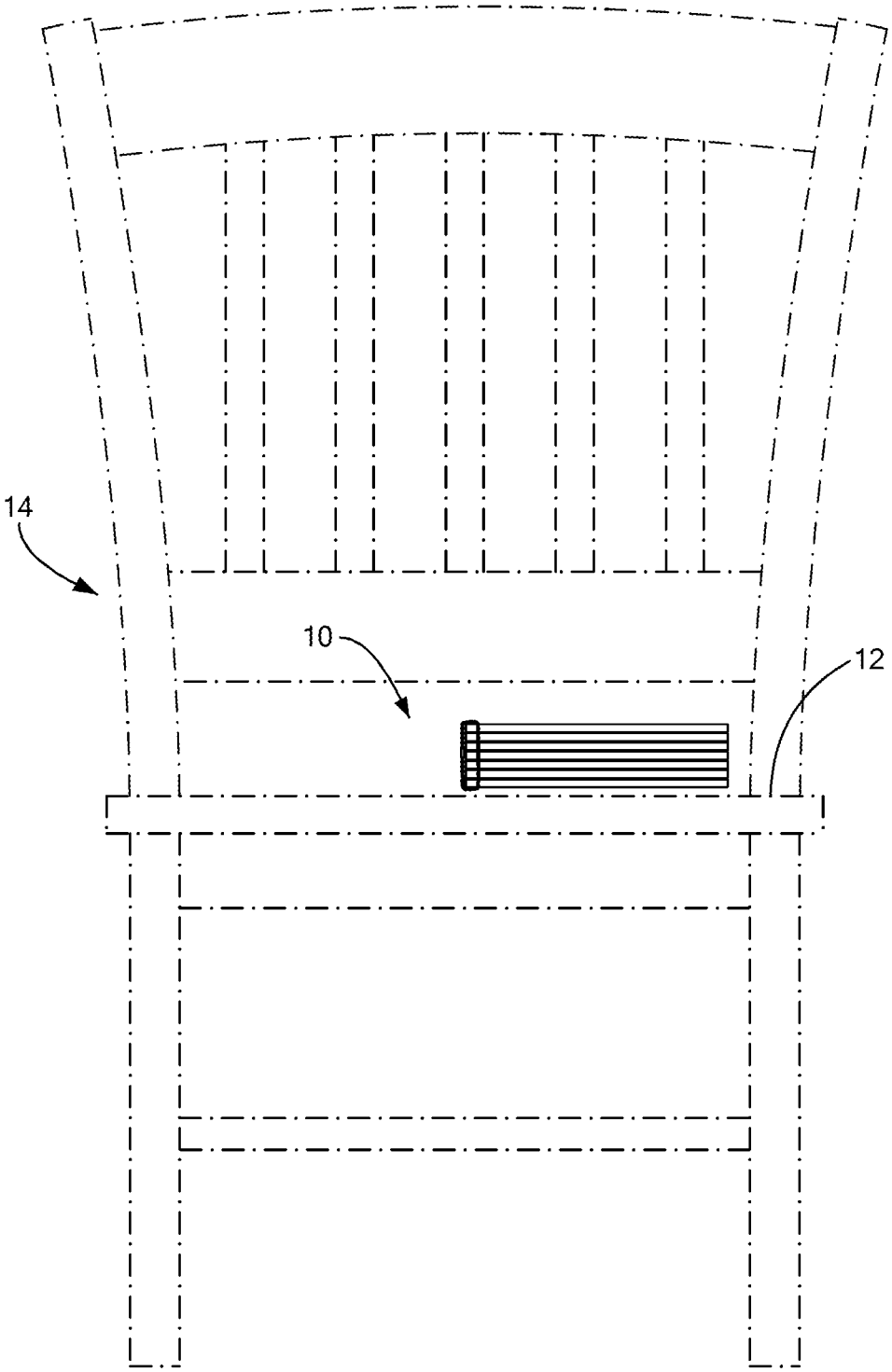
FIG. 3B is a front plan view of the support of FIG. 2 as used on a chair illustrating adjustable lifts stacked on only the right platform.
Figure 4:
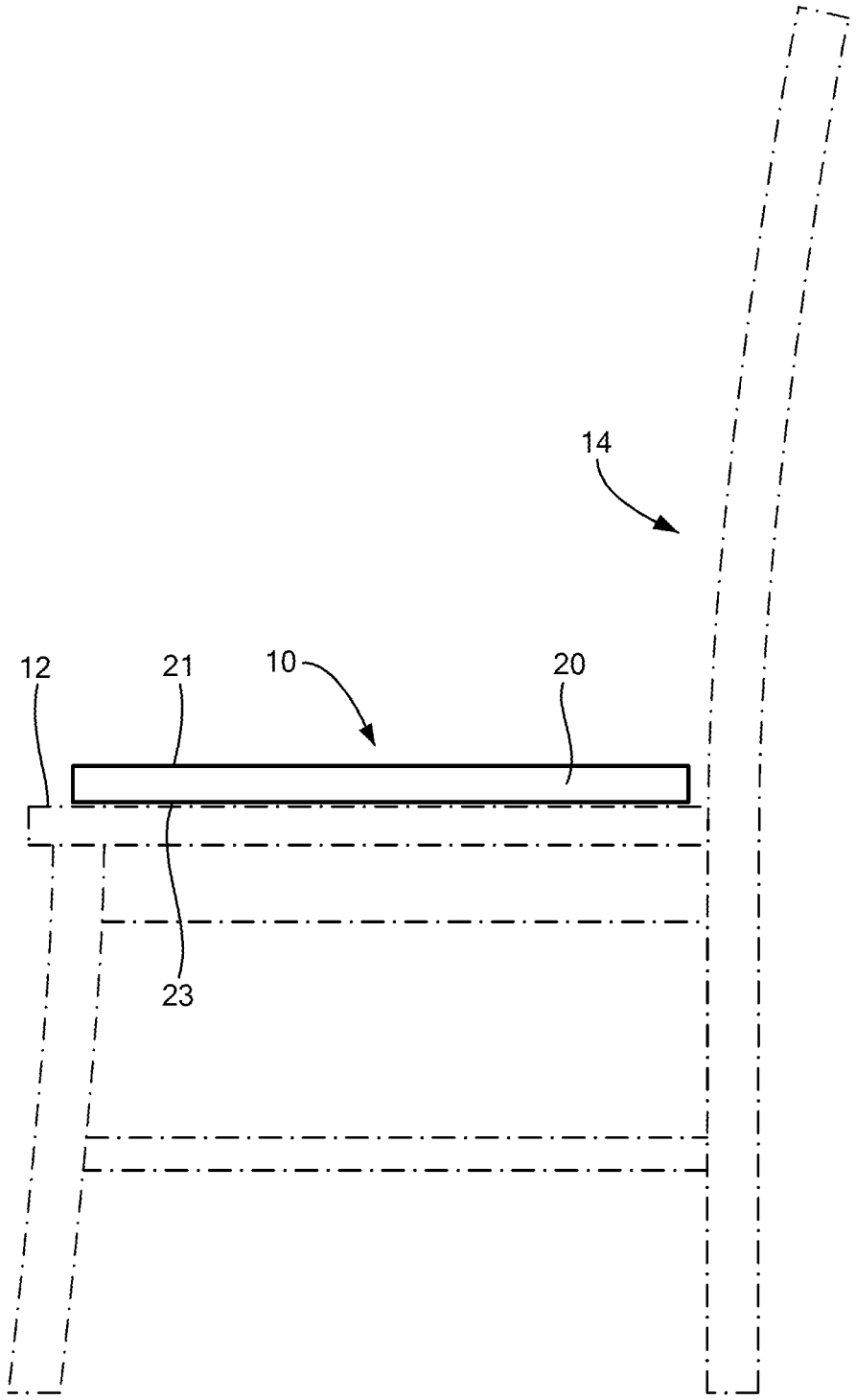
FIG. 4 is a side plan view of the support of FIG. 3.
Figure 6:
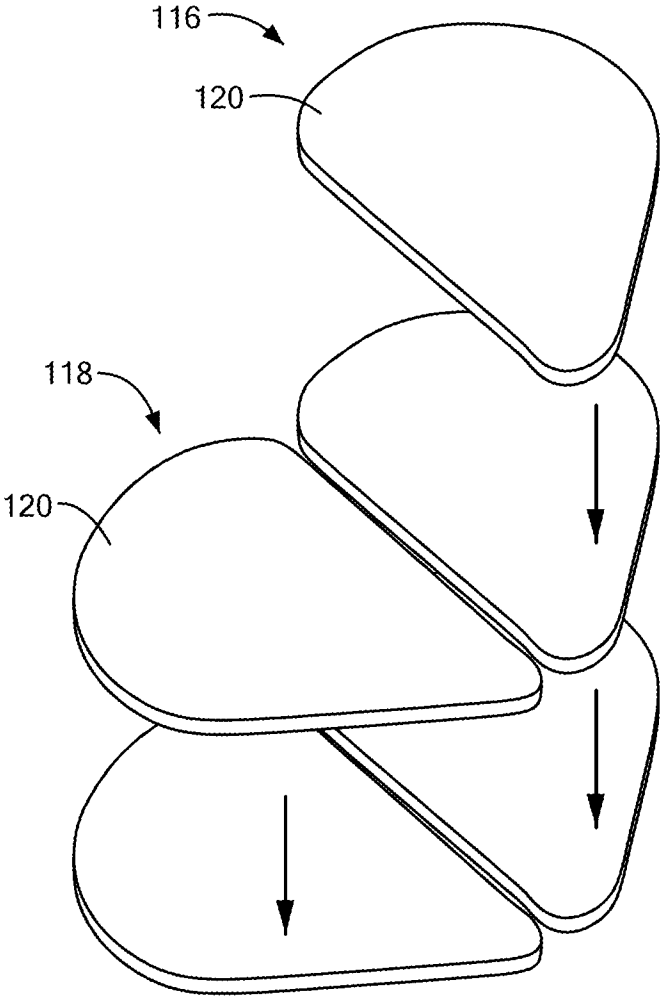
FIG. 6 is an exploded view of the support of FIG. 5 with multiple adjustable lifts.

Referring now to FIGS. 2-4, an adjustable support 10 for differentially adjusting and elevating the height of one of the user's sitz bones 4 during sitting is illustrated according to a first embodiment of the present disclosure. In this embodiment, the support 10 is used on a sitting surface 12, for example a chair 14, but may be utilized with any sitting surface.

As illustrated, the support 10 includes an adjustable left platform 16 and an adjustable right platform 18 that each include at least one relatively rigid lift 20. Lift 20 may have any desired shape, depending upon the particular use, and includes a first or top surface 21 and a second or bottom surface 22 with a thickness "t" therebetween. The lifts are shaped so that each lift can be stacked on top of the other, for example by the top surface and bottom surface having cooperating contours.

Together the left and right platforms 16, 18 include a plurality of lifts 20, each being relatively thin, for example from about ⅛"-¼" thick each. Each lift 20 is also made of a relatively stiff material, for example a thermoplastic, natural material such as rubber, or a dense foam that does not significantly compress, for example hard foams where additional support and higher load bearing is desired, and cushioning is not the primary concern. If cushioning is desired to provide a more compliant outer surface, it may be included, but the underlying material of the lift 20 still provides the stiffness and upward pressure needed to differentially raise one side of the sitz bone while sitting.

Figure 5:
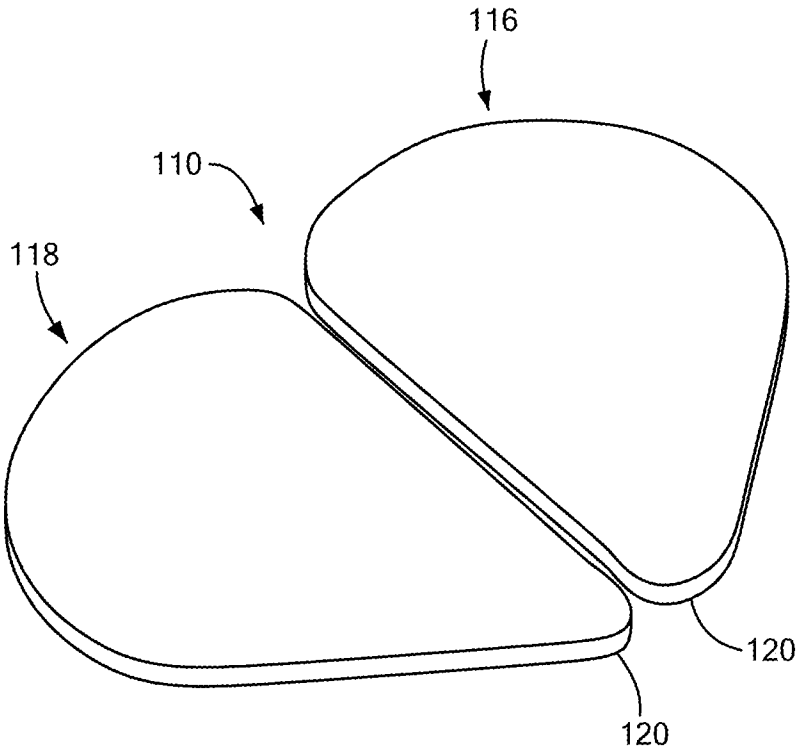
FIG. 5 is a perspective view of an adjustable support for differentially adjusting by raising the height of the user's painful side sitz bone during sitting in accordance with a second embodiment of the present disclosure.
Figure 7:
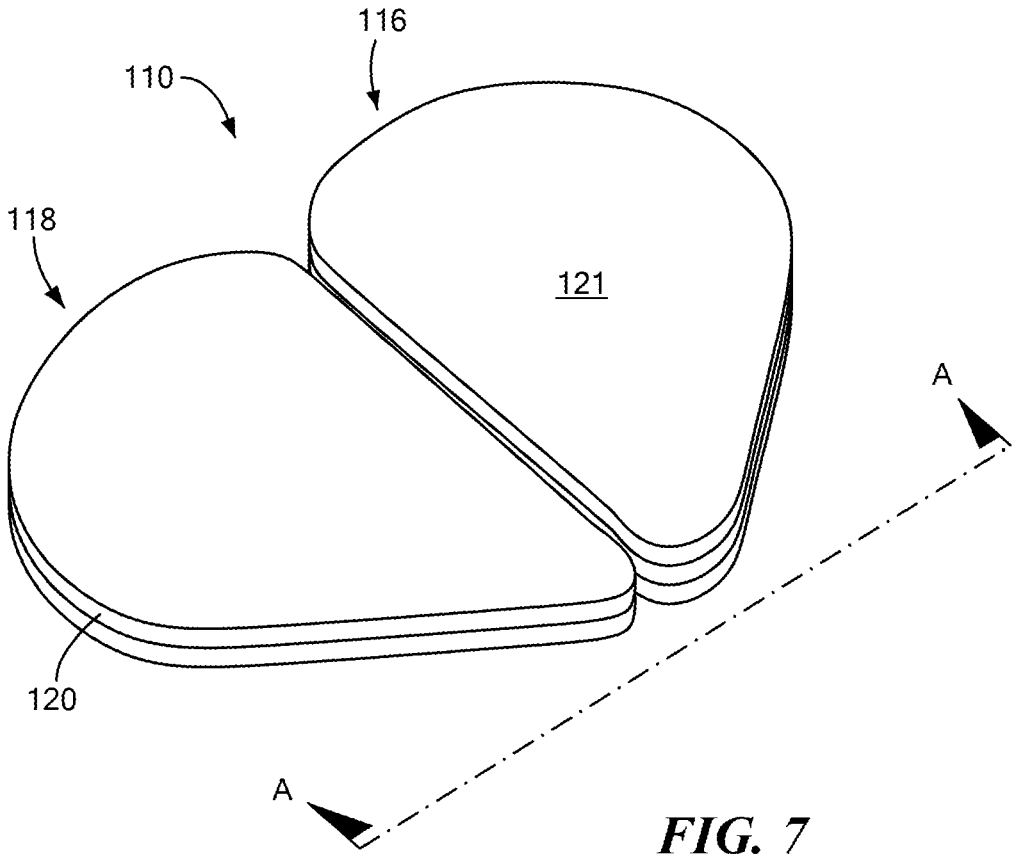
FIG. 7 is a perspective view of the support of FIG. 6 differentially stacked on both the left and right platform.

The lifts 20 may be connected along an inner edge 22 to each other in a hinged or flipped manner, so that the plurality of lifts 20 can be moved in order to adjust the height of either the left or right platforms 16, 18. As shown in FIG. 2, the height of the left platform 16 and the right platform 18 can each be incrementally adjusted by moving the lifts 20 from one platform position to the other, for example from "flipping" the lift from one side to the other if a binding is provided. In the present embodiment the lifts 20 are connected along their inner edge 22 by a lace-like binding 24 so that they can easily be flipped from one side to the next and even removed if so desired. The binding 24 as illustrated is flexible and can be made relatively flat for user comfort, for example by using thin nylon line or laces, or creased and bound like the pages of a book. As will be appreciated, the lifts 20 may also be individual pieces that are not connected along an inner edge and are stacked on the seat by the user, similar to the individual pieces shown in the embodiment of FIG. 5. In order to facilitate stacking and to prevent movement, a non-slip surface may also be included on the bottom surface 23 of the end lift.

During use, the individual can adjust to increase the height of the platform on the side that is providing discomfort or pain, in order to elevate the sitz bone 4 on that side. Depending upon the misalignment the adjustment can be from about ⅛" to over 1". The user stacks more lifts 20 on the side needing adjustment than the other in order to differentially lift the height of the one of the sitz bone and thereby the height of the painful side of the sacral/lumbar complex. In this manner the left and right platforms 16, 18 will have a differential height between them. As will be appreciated the differential height will be determined by the amount of adjustment needed. In some cases, it may be that both sitz bones need some lifting and upward pressure applied by the stackable lifts 20.

The elevation of the sitz bone(s) in this manner provides a counterbalancing repositioning of the sacral/lumbar complex 6, thus relieving the pressure on pain sensitive structures of the low back and hip 8 to relieve discomfort while sitting. As time goes on the sitz bones 4 may become more aligned with each other, and the individual can adjust the differential height to a lower difference between each of the left platform 16 and right platform 18.

Referring now to FIGS. 5-11, an adjustable support 110 for differentially adjusting the height of the user's lower sitz bones 4 during sitting is illustrated according to a second exemplary embodiment of the present disclosure. In this embodiment, the same or similar elements as those in FIGS. 2-4 utilize the same two-digit base number preceded by the number "1." Adjustable support 110 includes an adjustable left platform 116 and an adjustable right platform 118 that each includes at least one relatively rigid stackable lift 120, each lift 120 having top surface 121 and a bottom surface 123 with a thickness "t" therebetween from about ⅛"-¼". The lifts 121 are shaped so that each lift can be stacked on top of the other, for example by the top surface and bottom surface having cooperating contours. The lifts 120 are illustrated as separate pieces in this embodiment as they are designed for insertion within a piece of clothing 26, for example pants 28. Alternatively, the lifts 120 may be utilized with any of a variety of different clothing, for example shorts, undergarments, skirts, and the like and may be connected along an edge as in the previous embodiment.

Figure 9:
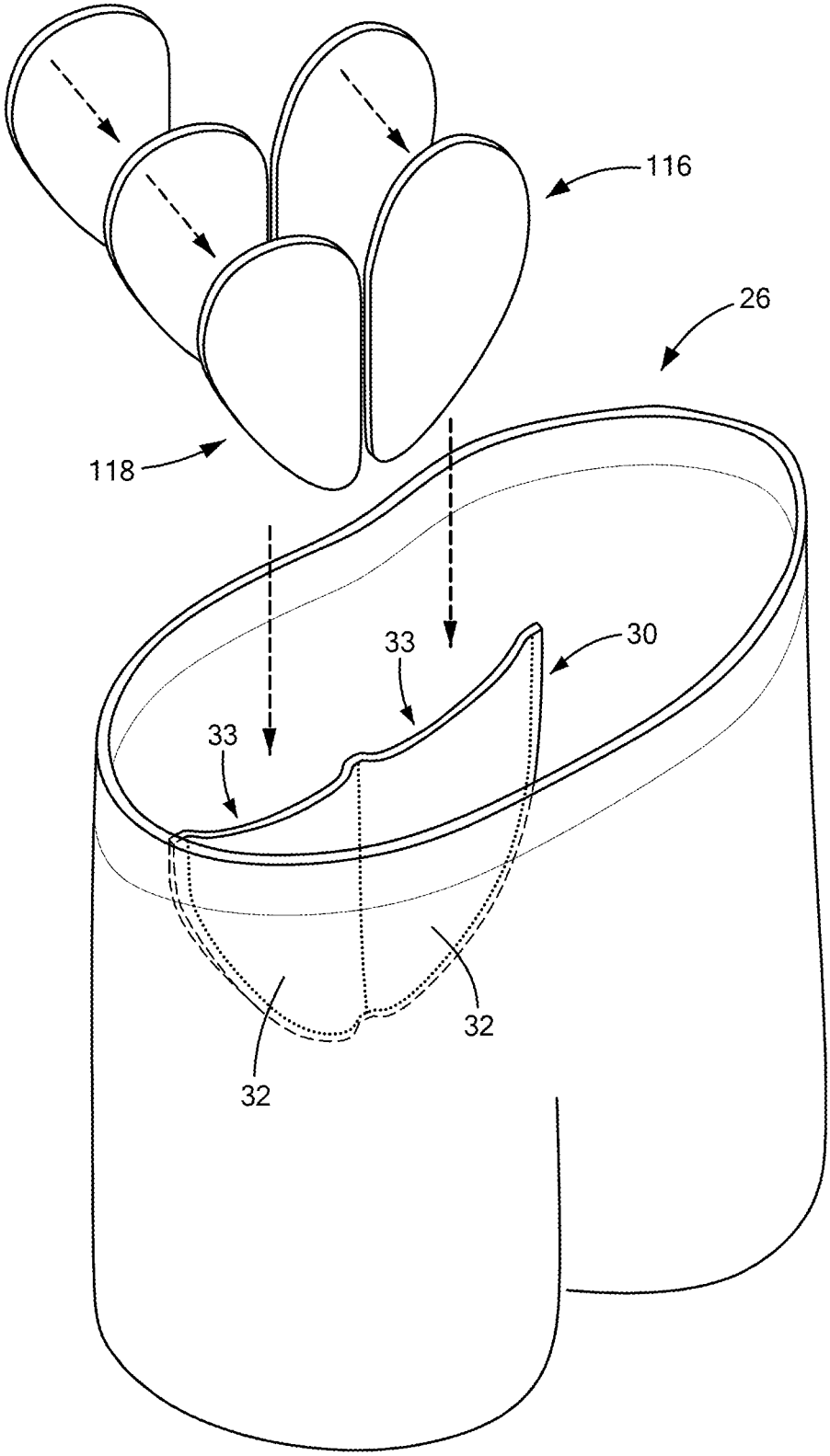
FIG. 9 is a perspective view of the support of FIG. 6 illustrating insertion into left and right pockets of a piece of clothing.
Figure 11:
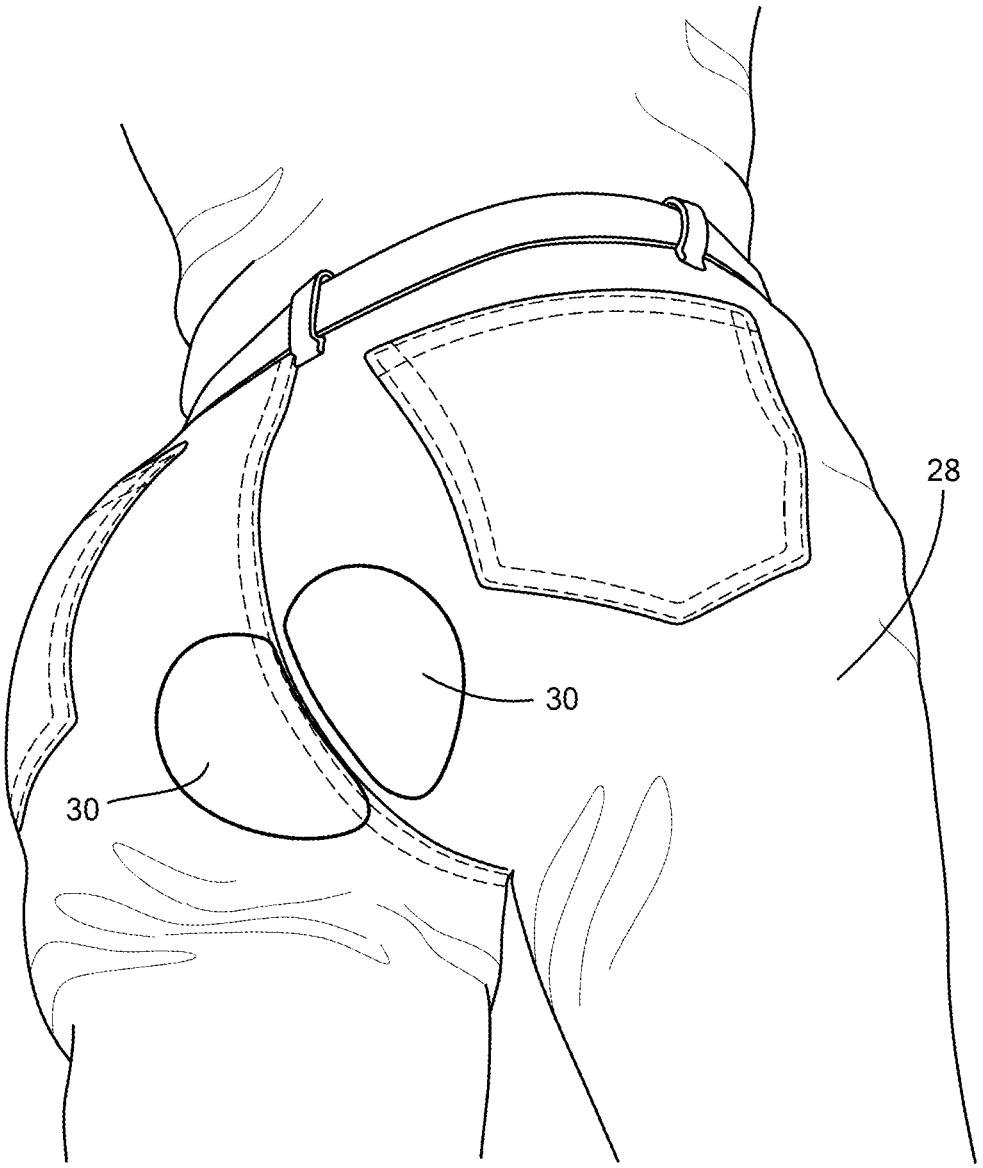
FIG. 11 is a perspective view of the support of FIG. 5 supported on a user wearing pants.

The piece of clothing 26 includes a pocket or pouch 30 that is shaped and sized to receive the lifts 120 therein, as best illustrated in FIG. 9. Those skilled in the art will understand that a variety of shapes for the support may be used to fit appropriately in various clothing and is not limited by the shape draw herein. The pouch 30 may be a single pouch having one compartment or may have separate compartments 32 one for each of the left and right platforms 116, 118. Alternatively, individual pouches 30 may be provided as illustrated in FIG. 11. The one or more pouches 30 are preferably located on an inside surface of the garment and are positioned in the area where the sitz bones 4 are located. The pouch 30 includes an opening 33 for receiving the lifts 120 therein, and may also include a closure, such as hook and loop fasteners, buttons, snaps, zippers, or the like, in order to secure the lifts 120 within the one or more pouches 30.

Figure 8A:
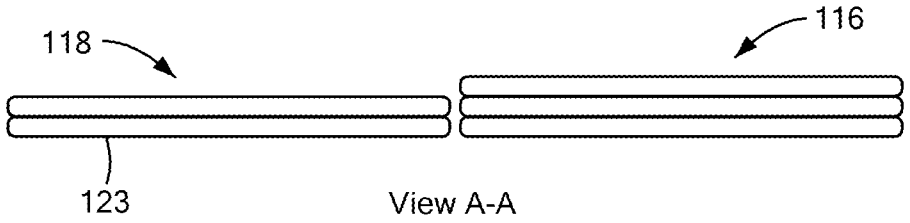
FIG. 8A is a cross-sectional view of the support of FIG. 5 taken along lines A-A of FIG. 7.
Figure 8B:
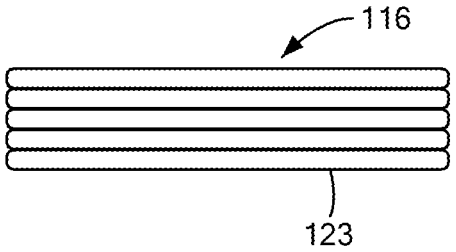
FIG. 8B is a cross-sectional view of the support of FIG. 8A with the lifts being stacked on only a single platform that can be inserted into either the left or right pocket.
Figure 10:
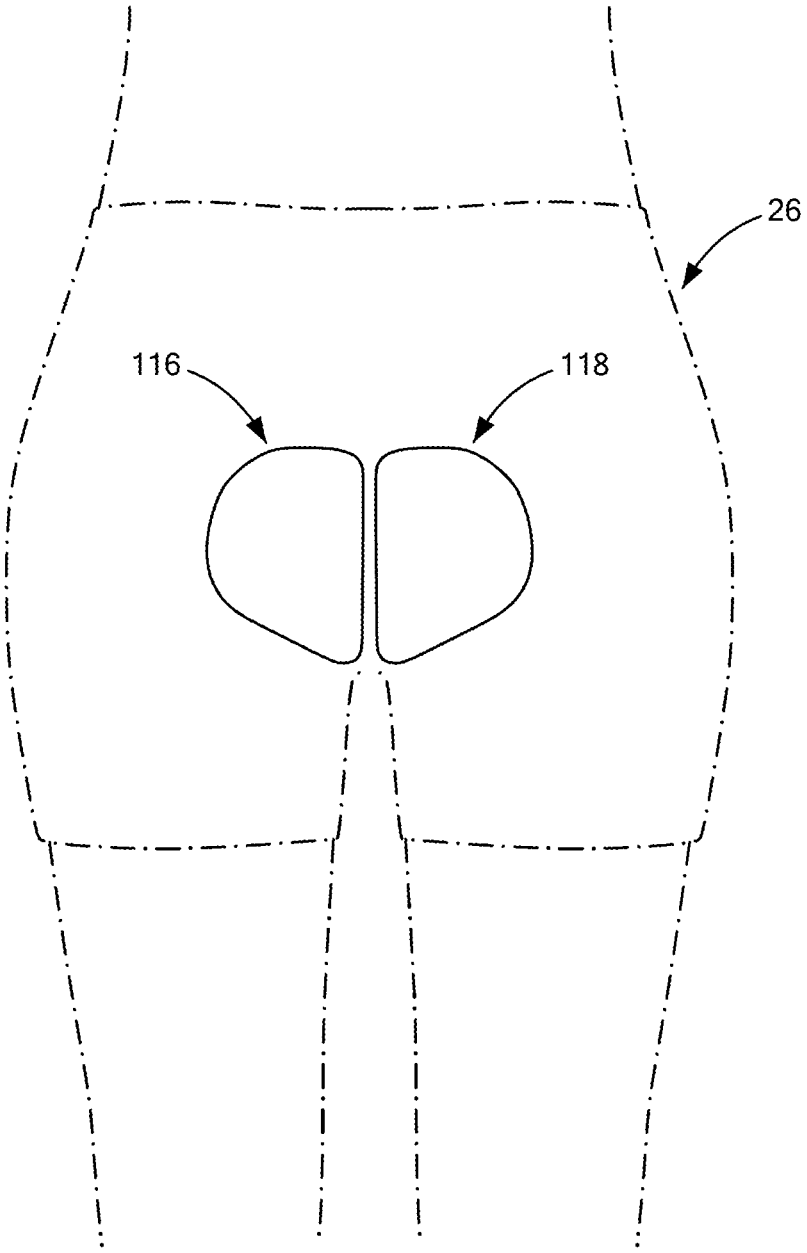
FIG. 10 is a diagrammatic view of the position of the support of FIG. 9 position on the piece of clothing in the area of the sitz bones.

As illustrated in the present exemplary embodiment, the lifts 120 and pouch may have a tear-drop shape such that the wider portion is in the area of the sitz bones on the buttocks and narrows toward the forward portion for increased comfort for the user, as best shown in FIGS. 10 and 11. Alternatively, other shapes may be utilized. For example, the shape may be more oval and not taper toward the front, or more square or rectangular when used on a seat. As with the previous embodiment the number of lifts 120 that are placed in each pouch 30 depends upon the misalignment and the preference of the user. The user may prefer when sitting and when wearing clothing fitted with the lifts 120 to have a similar rigid surface underneath each side of the buttocks and may choose to put one or more lifts 120 on the side that does not require adjustment (FIG. 8A). Alternatively, the user may reduce the number of lifts on one side so that one side has no lifts, and the other side has all the lifts (FIG. 8B) that creates the desired differential. In either case the differential between the sides may remain the same. The lifts provided in the other side will be determined by what differential height is needed between sitzs bones by elevating the painful side of the sacral/lumbar complex to relieve the pain of the user. Once adjusted by stacking more lifts 120 within one pouch 30 or compartments 32 than the other in order to lift the height of one of the sitz bones, the left and right platforms will have a differential height between them. In some cases, it may be preferred to have both sitz bones lifted with upward pressure applied by the lifts 120.

During use, the individual can adjust the height on the side that is providing discomfort or pain, in order to elevate the sitz bone 4 on that side. Depending upon the misalignment the adjustment can be from about ⅛" to over 1". As time goes on and the sitz bones 4 become more aligned with each other, the individual can adjust the differential height to a lower difference between each of the left platform 116 and right platform 118.

Having thus described several aspects of at least one example, it is to be appreciated that various alterations, modifications, and improvements will readily occur to those skilled in the art, without departing from the spirit and scope of the invention as defined by the appended claims. Therefore, the claims are not to be limited to the specific examples depicted herein. For example, the features of one example disclosed above can be used with the features of another example. For instance, examples and embodiments disclosed herein may also be used in other contexts. Furthermore, various modifications and rearrangements of the parts may be made without departing from the spirit and scope of the underlying inventive concept. For example, the geometric configurations disclosed herein of the lifts and the pouches along with their sizes and number may be altered depending upon the application, as may the material selection for the components. Such alterations, modifications, and improvements are intended to be part of this disclosure and are intended to be within the scope of the examples discussed herein. Thus, the details of these components as set forth in the above-described examples, should not limit the scope of the claims.

Further, the purpose of the Abstract is to enable the U. S. Patent and Trademark Office, and the public generally, and especially the scientists, engineers and practitioners in the art who are not familiar with patent or legal terms or phraseology, to determine quickly from a cursory inspection the nature and essence of the technical disclosure of the application. The Abstract is neither intended to define the claims of the application nor is intended to be limiting on the claims in any way.

What is claimed:

1. An adjustable support for differentially adjusting a height of at least one sitz bone of a user during sitting, comprising:

a plurality of stackable lifts, each lift including an upper surface and an opposing bottom surface defining a thickness therebetween, each of the plurality of stackable lifts comprising a stiff material configured to provide lift to the at least one sitz bone when sitting, the upper surface and bottom surface of each of the plurality of stackable lifts including cooperating contours constructed and arranged to be stacked one on top of the other to support the user during sitting;

an adjustable left platform and an adjustable right platform each including:

a) at least one of the plurality of stackable lifts; and b) a height defined by the thickness and number of the at least one of the plurality of stackable lifts therein;

the plurality of stackable lifts of the left platform and the plurality of stackable lifts of the right platform each including an inner edge hinged to a binding;

wherein the height of each of the adjustable left platform and the adjustable right platform is incrementally adjusted by moving at least one of the plurality of stackable lifts from one of the left side or one of the right side to the opposing side; and wherein during use one of at least the adjustable right platform and adjustable left platform provides pressure to lift at least one of the user's sitz bones in order to adjust the height of at least one sitz bone relative to the other of the user's sitz bone.

2. The adjustable support of claim 1, wherein the plurality of stackable lifts each have a thickness between about ⅛" to ¼".

3. The adjustable support of claim 1, wherein the plurality of stackable lifts is made of a material chosen from the group consisting of a thermoplastic, natural material or dense foam.

4. The adjustable support of claim 1, further comprising a compliant outer surface.

5. The adjustable support of claim 1, wherein during use one of the left platform and the right platform has a greater height than the other platform.

6. The adjustable support of claim 5, wherein the plurality of stackable lifts each include a complimentary shape and are sized to use on a seat surface.

7. The adjustable support of claim 6, wherein at least one of the plurality of stackable lifts includes a non-slip surface on at least one of a top surface and the bottom surface.

* * * * *